US005832890A

United States Patent [19]

Ikeya et al.

[11] Patent Number: 5,832,890

[45] Date of Patent: Nov. 10, 1998

[54] AIR INTAKE DEVICE FOR OUTBOARD BOAT ENGINE

[75] Inventors: Toshiaki Ikeya, Shizuoka-Ken; Mitsuhiko Ohta, Iwata-Gun; Naoki Kawasaki, Shizuoka-Ken, all of Japan

[73] Assignee: Suzuki Motor Corporation, Shizuoka-Ken, Japan

[21] Appl. No.: 846,516

[22] Filed: Apr. 29, 1997

[30] Foreign Application Priority Data

Apr. 30, 1996 [JP] Japan ..... 8-109531

[51] Int. Cl.[6] ..... F02M 35/10

[52] U.S. Cl. ..... 123/184.34; 123/184.47

[58] Field of Search ..... 123/184.34, 184.43, 123/184.42, 184.24, 195 HC, 196 W

[56] References Cited

U.S. PATENT DOCUMENTS 5,513,606 5/1996 Shibata ..... 123/184.34

5,553,586 9/1996 Koishikawa et al. ..... 123/184.34

5,630,390 5/1997 Tsunoda et al. ..... 123/184.34

5,713,771 2/1998 Takahashi et al. ..... 123/184.34

*Primary Examiner*—Marguerite McMahon

*Attorney, Agent, or Firm*—Finnegan, Henderson, Farabow, Garrett & Dunner, L.L.P.

[57] ABSTRACT

An air intake device for a vertically oriented multi-cylinder outboard boat engine having vertically spaced fuel intake ports. The air intake device includes a surge tank, a plurality of vertically spaced air intake pipes extending from the surge tank to the engine intake ports. The intake pipes are inclined downward from the surge tank. The bottom tangent of the lowermost intake pipe is aligned with the bottom surface of the surge tank and the vertical length of the surge tank is less than the total length from the uppermost intake port to the lowermost intake port.

4 Claims, 4 Drawing Sheets

AIR INTAKE DEVICE FOR OUTBOARD BOAT ENGINE

BACKGROUND OF THE INVENTION

1. Field of Invention

This invention relates to an outboard boat engine air intake device. More particularly, this invention relates to an air intake device that accounts for the flow of excess motor fluids to the engine.

2. Description of Related Art

Many outboard boat engines house, in a vertical manner, a multi-cylinder engine that has two or more cylinders such that the crank shaft is vertically oriented. Recently, fuel injection air intake devices have become widely used in the engines of this type.

Fuel injection air intake devices found in vertically housed multi-cylinder engines include a surge tank that regulates the air flow, as well as air intake pipes that extend substantially horizontally from the surge tank to the respective intake ports of the engine and are arranged in multiple vertical stages. Also, the surge tank has a throttle valve that regulates the amount of air that is taken in, and fuel injectors that inject fuel into the intake ports.

When the throttle valve opens, fresh air flows into the surge tank and into the intake ports through the various air intake pipes. Fuel injected near the intake ports by the injectors flows into and is mixed with this fresh air to create a combustible gaseous mixture, which is then taken into the engine. A breather pipe extends from the engine cylinder head and is connected to the throttle valve.

Excess gas, oil, water, and other such fluids, sometimes collect in the engine and cannot be directly discharged outside the engine. This excess fluid flows through the breather pipe to the surge tank, and is reintroduced into the engine.

Often, this excess fluid collects in the bottom of the surge tank. When this happens, the throttle valve can suddenly close forcing a large amount of excess fluids into the engine from the lowest intake pipe at one time. This can adversely affect the operation of the engine. To prevent this, it is desired that the flow of excess fluid to the engine be substantially constant and uniform.

Another problem encountered in conventional air intake devices arises when blow-back or other conditions of the engine cause excess fluids to flow in reverse and back into the surge tank.

Thus, an outboard boat engine air intake device is needed that prevents the pooling of excess fluids in the surge tank and the air intake pipes, and that further prevents the reversal of flow of fluids in the air intake pipes as the fluid flows toward the engine.

SUMMARY OF THE INVENTION

Accordingly, the present invention is directed to an air intake device for an outboard boat engine that substantially obviates one or more of the problems due to the limitations and disadvantages of the related art.

Additional advantages of the invention will be set forth in the description which follows, and in part will be apparent from the description or may be learned by practice of the invention. The advantages of the invention may be realized and obtained by means of the combinations particularly pointed out in the appended claims.

To achieve these and other advantages and in accordance with the purpose of the invention, as embodied and broadly described, the invention includes an air intake device for a vertically oriented multi-cylinder outboard boat engine having vertically spaced fuel intake ports. The invention further includes an air intake device including a surge tank, a plurality of vertically spaced air intake pipes extending from the surge tank to the engine intake ports. The air intake pipes are inclined downward from the surge tank, and the bottom tangent of the lowermost air intake pipe is connected at the bottom surface of the surge tank. Further, the vertical length of the surge tank is less than the total length from the uppermost intake port to the lowermost intake port.

In another aspect of this invention, the air intake pipes are gently curved to form upwardly oriented central regions.

It is to be understood that both the foregoing general description and the following detailed description are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate several embodiments of the invention and together with the description serve to explain the principles of the invention. In the drawings.

DETAILED DESCRIPTION OF THE PREFERRED EMBODIMENTS

Reference will now be made in detail to the present preferred embodiments of the invention, examples of which are illustrated in the accompanying drawings.

Figure 1:
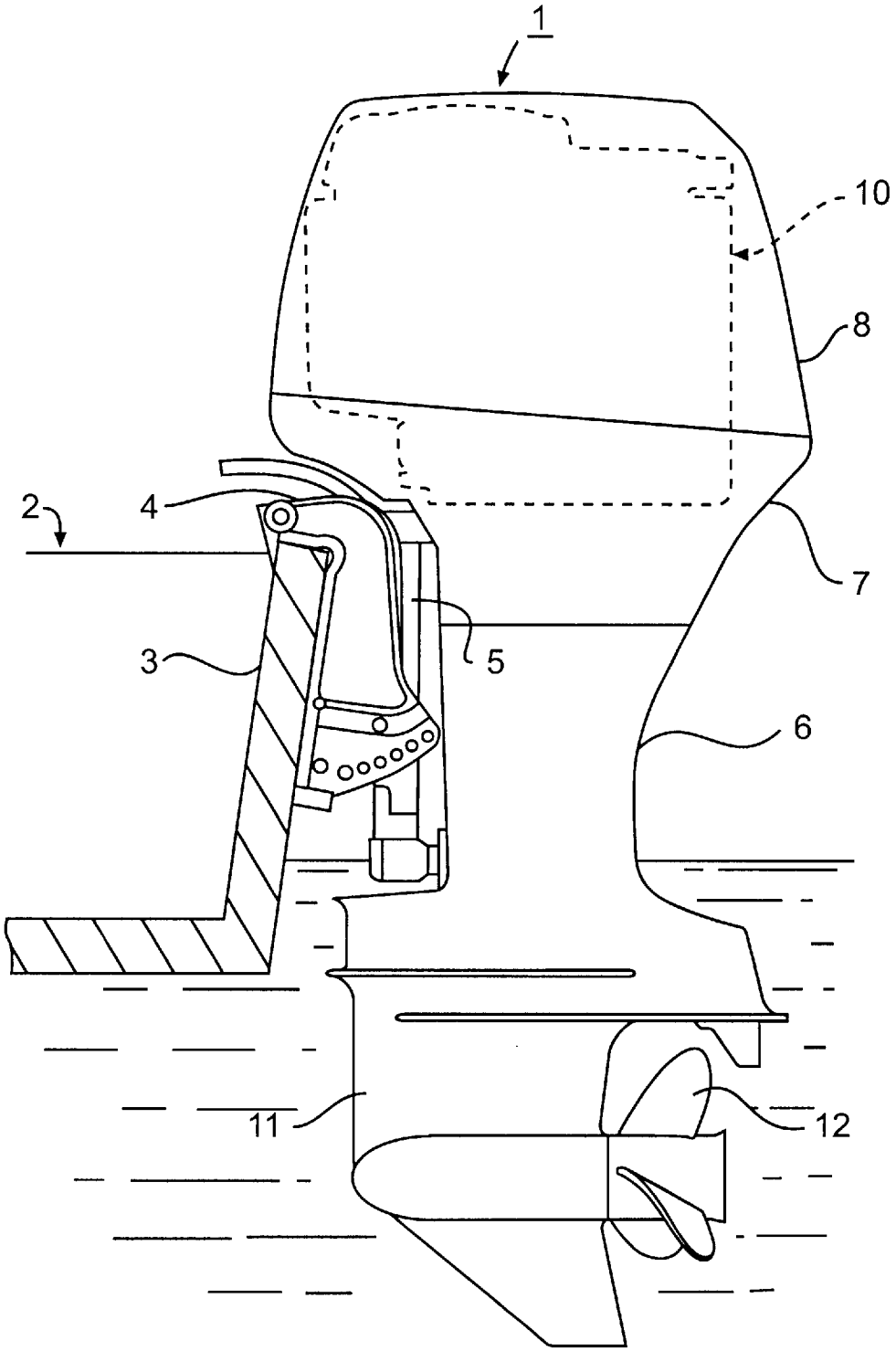
FIG. 1 is a side view of an example of an outboard motor in which the air intake device of this invention is used.

As shown in FIG. 1, an outboard boat motor 1 is mounted on a transom 3 on the body of a boat 2 by a clamp bracket 4 so that the motor can pivot freely oscillate on a swivel shaft 5, secured to the motor 1.

A drive housing 6, which occupies the center of the outboard boat motor 1, is joined to the clamp bracket 4 by the swivel shaft 5. Located above the drive housing 6 is a two-part engine cover 7, 8 in which an engine 10 is stored. The engine 10 is housed such that the crank shaft thereof (not shown) is vertically oriented.

A gear case 11 is provided in the lower part of the drive shaft housing 6, and a propeller 12 is supported by a shaft (not shown) in the back of the gear case 11. Moreover, the propeller 12 is rotationally driven by a drive shaft that extends vertically downward from the engine 10.

Figure 2:
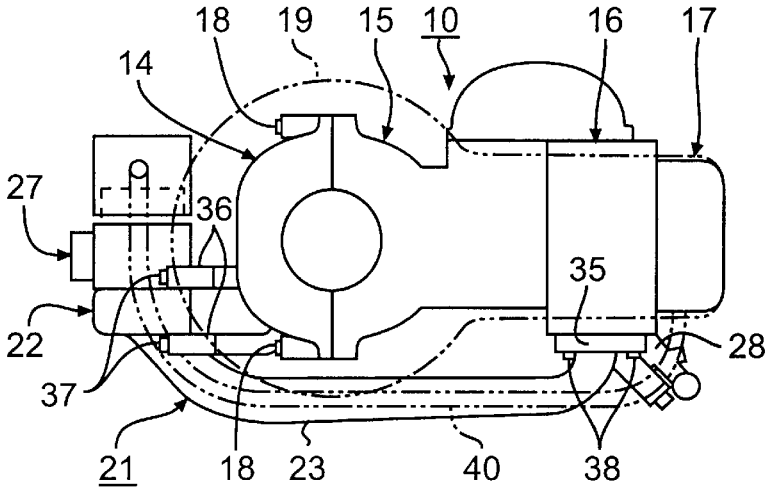
FIG. 2 is a top view of an engine in accordance with this invention.
Figure 3:
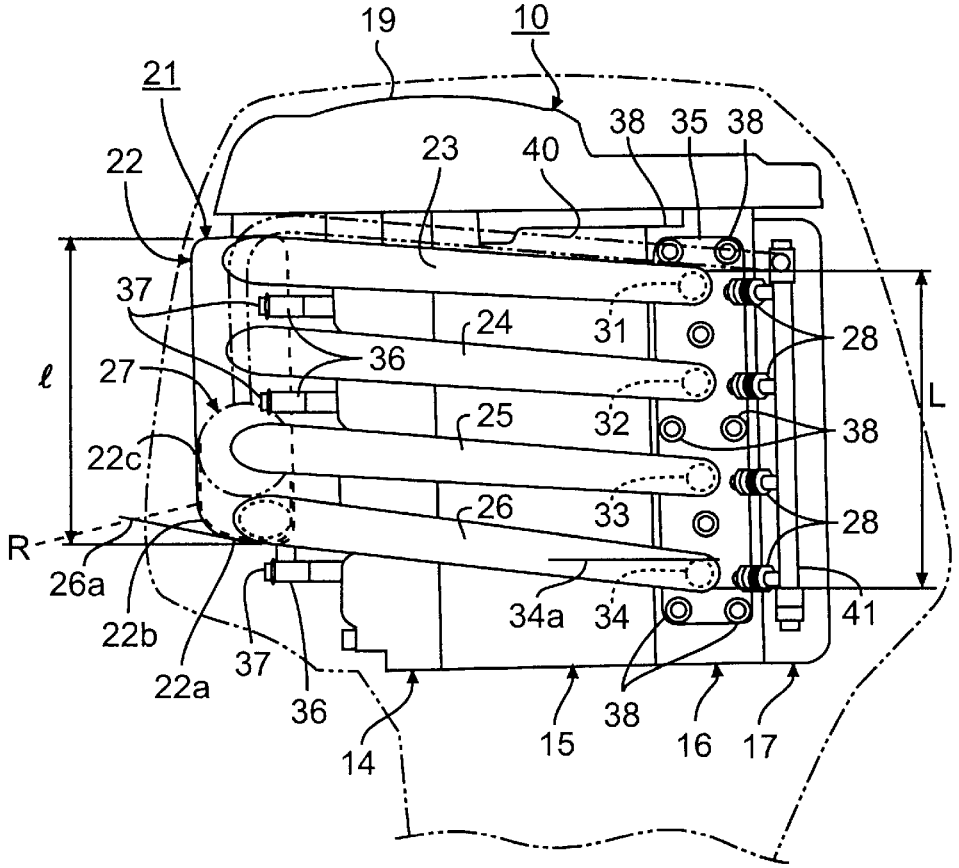
FIG. 3 is a side view of an engine in accordance with this invention.
Figure 4:
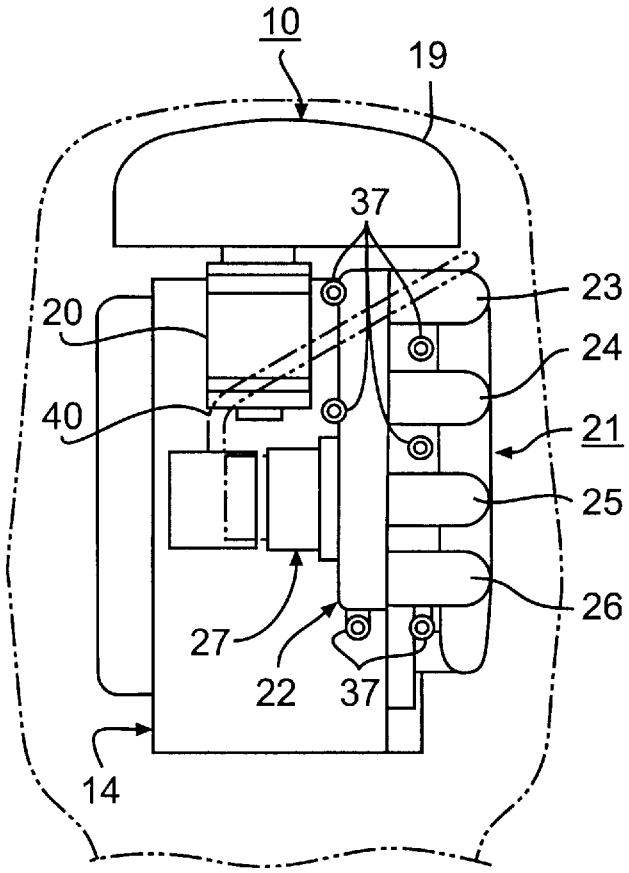
FIG. 4 is a frontal view of an engine in accordance with this invention.

As shown in FIGS. 2–4, the engine 10 is a four-cycle gasoline engine including a crank case 14 in which a crank shaft extends vertically, a cylinder block 15, a cylinder head 16, and a head cover 17 attached by bolts 18 to the crank case 14. A flywheel cover 19 overlying a flywheel (not shown) is mounted on top of the engine 10.

In accordance with the invention, an outboard boat engine air intake device is provided. The air intake device of this invention includes a surge tank 22 to regulate the supply of combustion air to the engine and is attached to the front of the crank case 14. A plurality of air intake pipes 23–26 extend from the left side of the surge tank 22. A single throttle valve 27 controls the amount of air taken into the surge tank 22. It is preferred that the plurality of air intake pipes 23–26 are arranged in vertical stages to facilitate connection of the air intake pipes to respective air intake ports 31–34 opened in the left side of the cylinder head 16.

The front ends of the air intake pipes 23–26 are mounted in a single intake manifold cover 35, which is connected by bolts 38 to the cylinder head 16. Also, the connection bosses 36 on the surge tank 22 are connected to the crank case 14 by bolts 37. It is preferred that the throttle valve 27, which regulates the amount of air taken into the surge tank 22, be located on the side of the surge tank 22. A breather pipe 40, which extends from the cylinder head 16, is connected to the throttle valve 27. Also, fuel injectors 28, with an associated fuel delivery pipe 41, are mounted in the intake manifold cover 35 so they face the interior of the intake ports 31–34.

When the throttle valve 27 opens, fresh air flows into the surge tank 22, then through the respective intake pipes 23–26, and into the intake ports 31–34. Fuel, injected from the fuel injectors 28 and into the intake ports 31–34, is blended with the fresh air to create a combustible gaseous mixture, which is then taken into the engine 10.

Often, excess gas, oil, water, and other excess fluids, collect in the engine 10 and cannot be directly discharged overboard from the engine 10. This excess fluid is transported into the surge tank 22 by the breather pipe 40 and reintroduced into the engine 10 through the several air intake pipes 23–26.

In accordance with the present invention, it is preferred that the vertical length l of the surge tank 22 be shorter than the total length L from the uppermost intake port 31 to the lowermost intake port 34 as shown in FIG. 3. This causes the angle of the lowermost intake pipe 26, in which the greatest volume of excess fluid flows, to be steeply inclined. Thus, pooling in the lowermost intake pipe 26 is substantially prevented.

It is also preferable that the surge tank 22 is located in a position higher than the crank case 14 so the various intake pipes 23–26 are inclined downward from the surge tank 22 to the respective intake ports 31–34 and, moreover, so that the bottom 22*a* of the surge tank 22 is higher than the top edge 34*a* of the lowermost intake port 34. Thus, even if blow-back or other conditions of the engine 10 cause excess fluids to flow in reverse, the excess fluids will be prevented from reaching the surge tank 22.

It is preferred that the bottom 22*a* of the surge tank 22 is inclined to be aligned with the bottom tangent 26*a* of the lowermost intake pipe 26. As shown in FIG. 3, the surge tank bottom 22*a* is inclined downwardly toward the engine 10. Furthermore, an internal surface R is formed in the curved wall portion 22*b* of the surge tank 22 that surrounds the bottom 22*a*. This internal surface R is provided with the largest radius at the front surface 22*c* of the surge tank 22.

Figure 5:
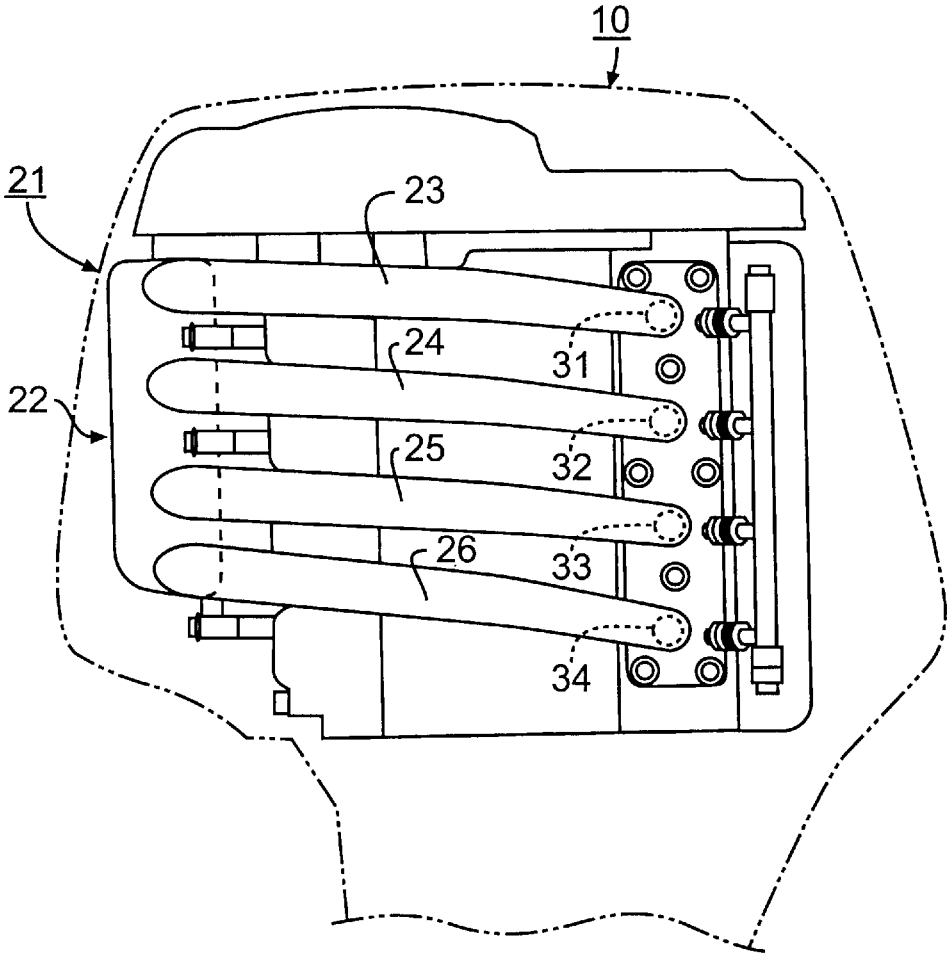
FIG. 5 is a side view of an engine that depicts another preferred embodiment of this invention.

In FIG. 5, another embodiment of the invention is shown. In this embodiment the intake pipes 23–26 are gently curved to form upwardly oriented central regions. As a result, the angle of inclination of the intake pipes 23–26 is gentle at the ends connected to the surge tank 22 but more steeply inclined in end portions at the intake ports 31–34. Thus, any excess fluid back flow from the engine 10 will be suppressed by the steeply inclined portions of the intake pipes near the engine 10, thus enhancing the prevention of back flow to the surge tank 22.

It will be apparent to those skilled in the art that various modifications and variations can be made in the air intake device for outboard boat engine of the present invention without departing from the spirit or scope of the invention. Thus it is intended that the present invention cover such modifications and variations of this invention provided they come within the scope of the appended claims and their equivalents.

What is claimed:

1. An air intake device for a vertically oriented multi-cylinder outboard boat engine having vertically spaced fuel intake ports, said air intake device comprising:

a surge tank; and a plurality of vertically spaced air intake pipes extending from said surge tank to the engine intake ports;

said air intake pipes being inclined downward from said surge tank; and arranged so that the bottom tangent of the lowermost of said air intake pipes is connected at the bottom surface of said surge tank and wherein the vertical length of said surge tank is less than the total length from an uppermost one of said intake ports to a lowermost one of said intake ports.

2. The air intake device of claim 1 whereby a curved internal surface is formed in a wall portion of said surge tank that surrounds said bottom surface.

3. The air intake device of claim 1 whereby the vertical location of the bottom surface of said surge tank is higher than the top edge of the lowest intake port.

4. The air intake device of claim 1 whereby the intake pipes are gently curved to form upwardly oriented central regions.

* * * * *